US005533318A

United States Patent [19]

Murat

[11] Patent Number: 5,533,318

[45] Date of Patent: Jul. 9, 1996

[54] NEWSPAPER STORAGE AND BUNDLING SYSTEM

[76] Inventor: Marie R. O. Murat, 11 Powderhorn Rd., Patterson, N.Y. 12563

[21] Appl. No.: 388,481

[22] Filed: Feb. 14, 1995

[51] Int. Cl.[6] ..... B65B 67/00

[52] U.S. Cl. ..... 53/390; 53/592; 100/34; 206/555

[58] Field of Search ..... 206/451, 555; 100/34; 53/390, 582, 586, 592

[56] References Cited

U.S. PATENT DOCUMENTS

| | | | |
|---|---|---|---|
| 2,321,802 | 2/1942 | Deybener | 100/34 |
| 3,491,681 | 1/1970 | Saro et al. | 100/34 |
| 3,780,854 | 12/1973 | Ruppenthal | 100/34 |
| 3,933,088 | 1/1976 | Pessagno | 100/34 |
| 4,681,032 | 7/1987 | McDermott | 100/34 |
| 4,926,748 | 5/1990 | Smith et al. | 100/34 |
| 4,934,262 | 6/1990 | Turi et al. | 100/34 |
| 4,964,518 | 10/1990 | Wilson | 211/50 |
| 5,027,576 | 12/1991 | Evans | 53/592 |
| 5,114,020 | 5/1992 | Martin | 100/34 |
| 5,255,967 | 10/1993 | Williams | 53/390 |
| 5,282,545 | 2/1994 | White | 220/403 |
| 5,322,008 | 6/1994 | Dixon | 100/34 |

*Primary Examiner*—John Sipos
*Assistant Examiner*—Gene L. Kim
*Attorney, Agent, or Firm*—Goldstein & Associates

[57] ABSTRACT

The invention is a newspaper storage and bundling system, comprising a bin having a bottom panel and four side panels attached to the bottom panel and perpendicular to one another, defining a storage space. A lip connects the side panels opposite the bottom panel. Four reels extend downward from the lip, each near the center of one of the side panels. A rope assembly comprises a rope assembly spacer and four rope ends extending from the rope assembly spacer. The rope assembly spacer is placed on the bottom panel and the rope ends are each wrapped around one of the reels. Newspapers and the like are collected inside the storage space into a newspaper pile, until it reaches the lip. The rope ends are then unwrapped from the reels and are brought together around the newspaper pile and are tied into a knot. A handle, having a base and four hooks extending outward and downward from the base, is centered over the knot, and is then pushed downward and twisted over the knot so that each hook catches one of the rope ends. The handle is then used to lift the newspaper pile.

8 Claims, 4 Drawing Sheets

NEWSPAPER STORAGE AND BUNDLING SYSTEM

BACKGROUND OF THE INVENTION

The invention relates to a newspaper storage and bundling system. More particularly, the invention relates to a system for storing newspapers until a significant quantity has accumulated, and then bundling the newspapers.

With the present trend toward recycling, many communities and municipalities have instituted regulations wherein a homeowner or commercial property operator must tie-up recyclable paper items, such as newspapers, into bundles before they will be accepted for collection.

The usual method of bundling newspapers involves neatly stacking newspapers on the floor, and then tying the bundle with cord or string unwound from a spool. Although operative, this practice is inconvenient because it involves the added step of collecting a pile of loose newspapers for the bundle, and then involves manipulating the pile during the tying operation. In addition, this method does not provide a neat storage place for the newspapers during the collection stage.

Even where bundling or recycling is not required by local statute, regulation, or ordinance, it is usually conducted voluntarily by environmentally conscious people. In addition, the accumulation of newspapers, magazines, and junk mail can be cumbersome. A storage and bundling device would eliminate the clutter of all these paper items.

Others have attempted to provide a solution, and have thereby provided storage and bundling devices.

U.S. Pat. Nos. 3,933,088 to Pessagno, 4,926,748 to Smith et al., 5,282,545 to White, and 5,322,008 to Dixon disclose newspaper bundling devices.

U.S Pat. Nos. 4,681,032 to McDermott, 4,934,262 to Turi et al., 4,964,518 to Wilson, and 5,072,576 to Evans, each disclose a storage bin that has a means for storing bundling straps or ropes within the bin.

While these units may be suitable for the particular purpose employed, or for general use, they would not be as suitable for the purposes of the present invention as disclosed hereafter.

SUMMARY OF THE INVENTION

It is an object of the invention to provide a device that has a bin for allowing newspapers, magazines, and the like to be conveniently stored until a sufficient quantity is collected to create a bundle.

It is another object of the invention to provide a device that will bundle and tie a pile of newspapers, magazines and the like.

It is a further object of the invention to provide a newspaper bundling device that has provisions for storing bundling ties, so that a bundle may be easily tied once a sufficient quantity of articles have been collected, without the need to first remove them from the bin.

It is a still further object of the invention to provide a device that provides a handle for quickly and easily lifting a tied bundle.

The invention is a newspaper storage and bundling system, comprising a bin having a bottom panel and four side panels attached to the bottom panel and perpendicular to one another, defining a storage space. A lip connects the side panels opposite the bottom panel. Four reels extend downward from the lip, each near the center of one of the side panels. A rope assembly comprises a rope assembly spacer and four rope ends extending from the rope assembly spacer. The rope assembly spacer is placed on the bottom panel and the rope ends are each wrapped around one of the reels. Newspapers and the like are collected inside the storage space into a newspaper pile, until it reaches the lip. The rope ends are then unwrapped from the reels and are brought together around the newspaper pile and are tied into a knot. A handle, having a base and four hooks extending outward and downward from the base, is centered over the knot, and is then pushed downward and twisted over the knot so that each hook catches one of the rope ends. The handle is then used to lift the newspaper pile.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
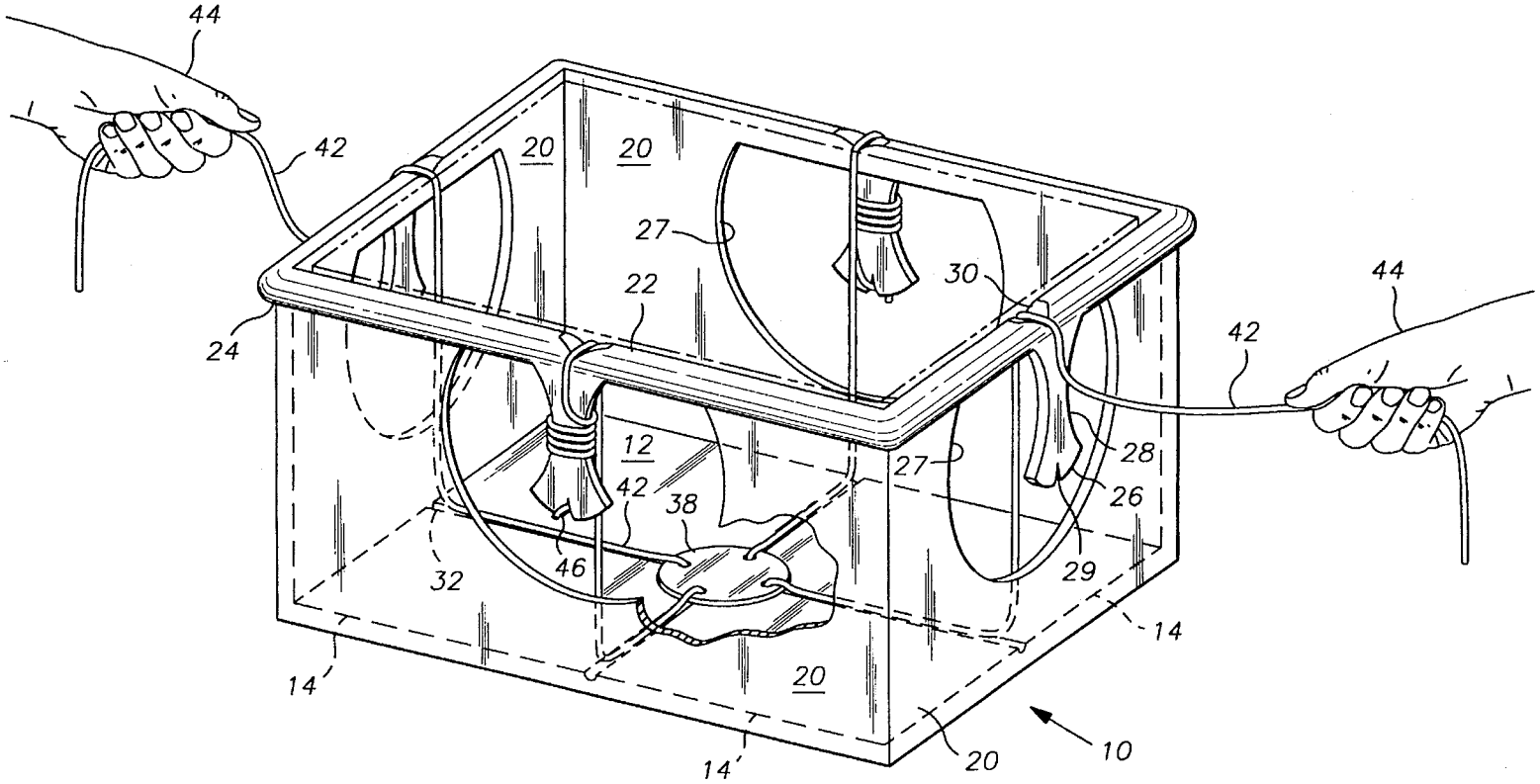
FIG. 1 is a diagrammatic perspective view of the instant invention, illustrating a bin being prepared for use.

FIG. 1 illustrates a bin 10, having a bottom panel 12. The bottom panel 12 is rectangular in shape, having four bottom edges 14. The bin 10 has four side panels 20 which extend perpendicularly upward from the bottom edges 14 of the bottom panel 12. The side panels 20 are attached to each other, and meet at right angles. The side panels 20 and the bottom panel 12 together define a storage space. In general, the bin 10 is in the shape of a rectangular prism, having an open top. Typically, the bin 10 is of a size capable of storing and bundling standard size newspapers. The size of the bin 10 may vary, so that it may also be capable of storing and bundling standard size magazines, junk mail, etc.

A lip 22 connects the four side panels 20, extending on the side panels 20 opposite the bottom panel 12 and parallel thereto. The lip 22 has an overhang 24 that extends perpendicular to the plane of the side panels 20 in a direction away from the storage space, thus outside the bin 10. Four reels 26 extend downward from the overhang 24 at each side panel 20. Each side panel has a semicircular opening 27 extending beneath the lip 22. The reels 26 hang downward from the overhang 24 directly in front of each semicircular opening 27. Each reel 26 has neck 28 for allowing rope or string to be easily wrapped around the reel 26. Each reel 26 also has a rope remainder notch 29 at an end of the reel 26 opposite the lip 22. A lip notch 30 is present in the lip 22 directly above each reel 26.

Figure 3:
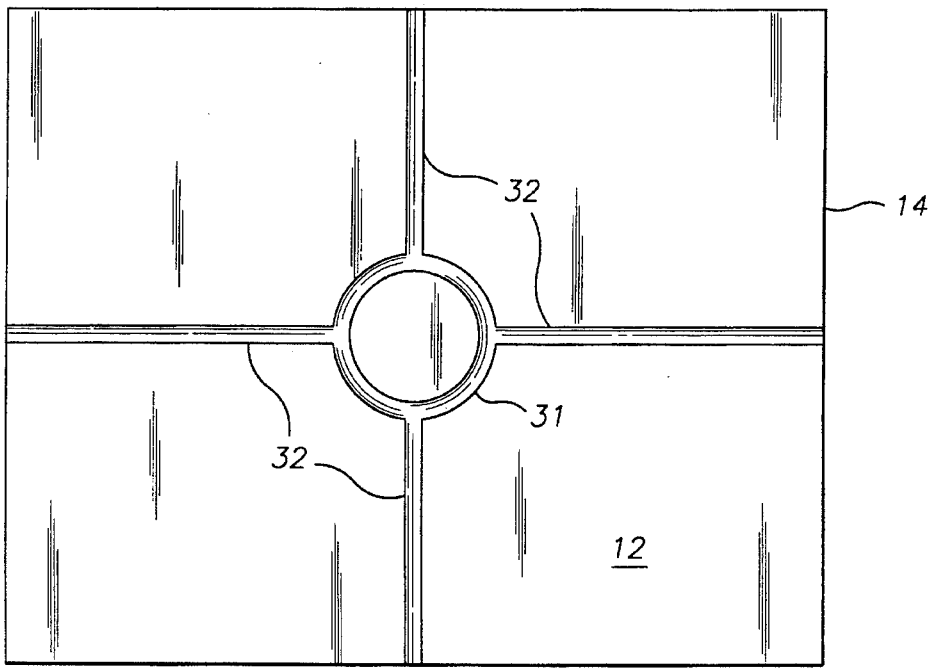
FIG. 3 is a top plan view of the invention showing a bottom panel of the bin.

Referring to FIG. 3, centered on the bottom panel 12 is a rope assembly recess 31. Extending laterally from the rope assembly recess 31 are rope channels 32. The rope channels 32 extend perpendicular to one another, each extending toward one of the bottom edges 14. Referring back to FIG. 1, each of the rope channels 32 extend to a point below one of the reels 26.

Figure 4:
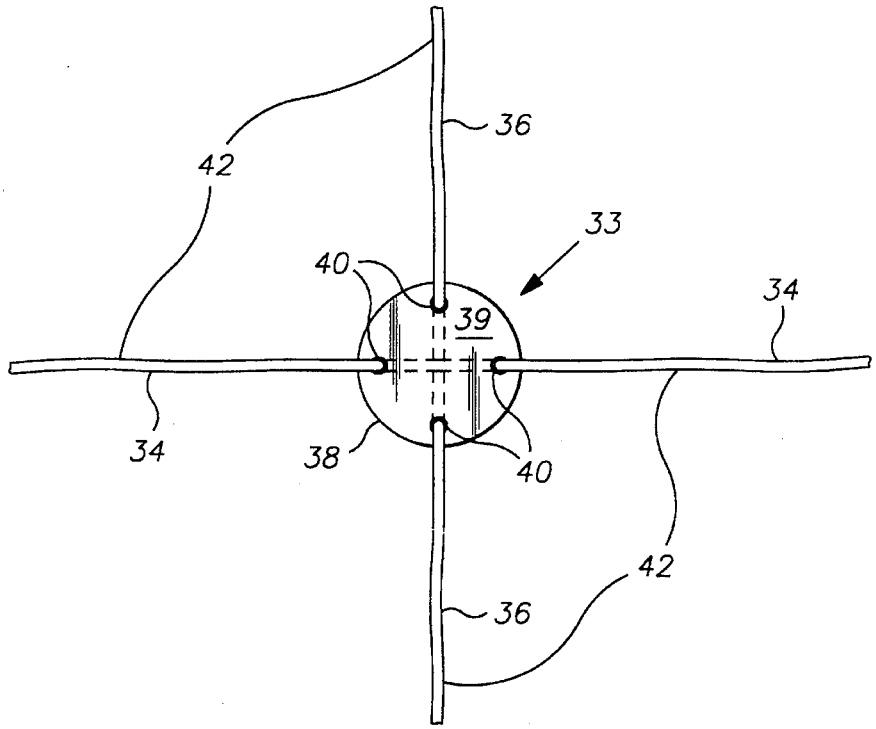
FIG. 4 is a top plan view of a rope assembly according to the present invention.

FIG. 4 illustrates a rope assembly 33. The rope assembly comprises a first rope 34 and a second rope 36, which cross beneath a rope assembly spacer 38. The rope assembly spacer 38 has a spacer top 39 and four spacer holes 40. The first rope 34 is threaded into one of the spacer holes from the spacer top 39, and then is threaded and emerges out of an opposite spacer hole, exiting at the spacer top 39. The second rope 36 is also threaded into one of the spacer holes, and then is threaded out of an opposite spacer hole in a similar fashion. Thus, the first rope 34 and second rope cross beneath the rope assembly spacer 38. In effect, the first rope 34 and second rope 36 create four rope ends 42, each extending outward from the rope assembly spacer 38 perpendicular to adjacent rope ends, and each rope end 42 exits the spacer hole 40 at the spacer top 39.

Referring back to FIG. 1, the bin 10 is being prepared for use in collecting and storing newspapers. The rope assembly spacer 38 has been placed in the rope assembly recess 31 in the bottom panel, with the rope ends 42 extending through the rope channels 32 toward the side panels 20. The rope ends 42 then travel directly up the side panels toward the lip notch 30 above each side panel 20. The rope ends 42 may be pulled by hands 44 to adjust the tension in the rope ends 42. The rope ends 42 extend over the lip 22 at each lip notch 30, and then extend downward toward the reel 26, where the rope ends 42 are wrapped around the neck 28. If the rope has a rope remainder 46 after the rope end is wrapped around the neck 28, this rope remainder 46 may be tucked into the rope remainder notch 29.

After each of the four rope ends 42 have been wrapped around one of the reels 26, the bin 10 is ready for newspaper collection. Newspapers, magazines, junk mail, or other paper materials are collected and stored in the storage space within the bin 10.

Once a sufficient quantity of materials have been collected, wherein the bin is filled to a point just beneath the lip 22, the bundling step should be performed. At this point it can be appreciated that the bin 10 should be constructed so that each reel 26 extends from the overhang 24, so that each reel 26 is slightly offset from the plane of the side panel 20. Thus, clearance is thereby provided between the reel 26 and collected materials to allow the rope ends 42 to be unwrapped once the bin is full.

Figure 2:
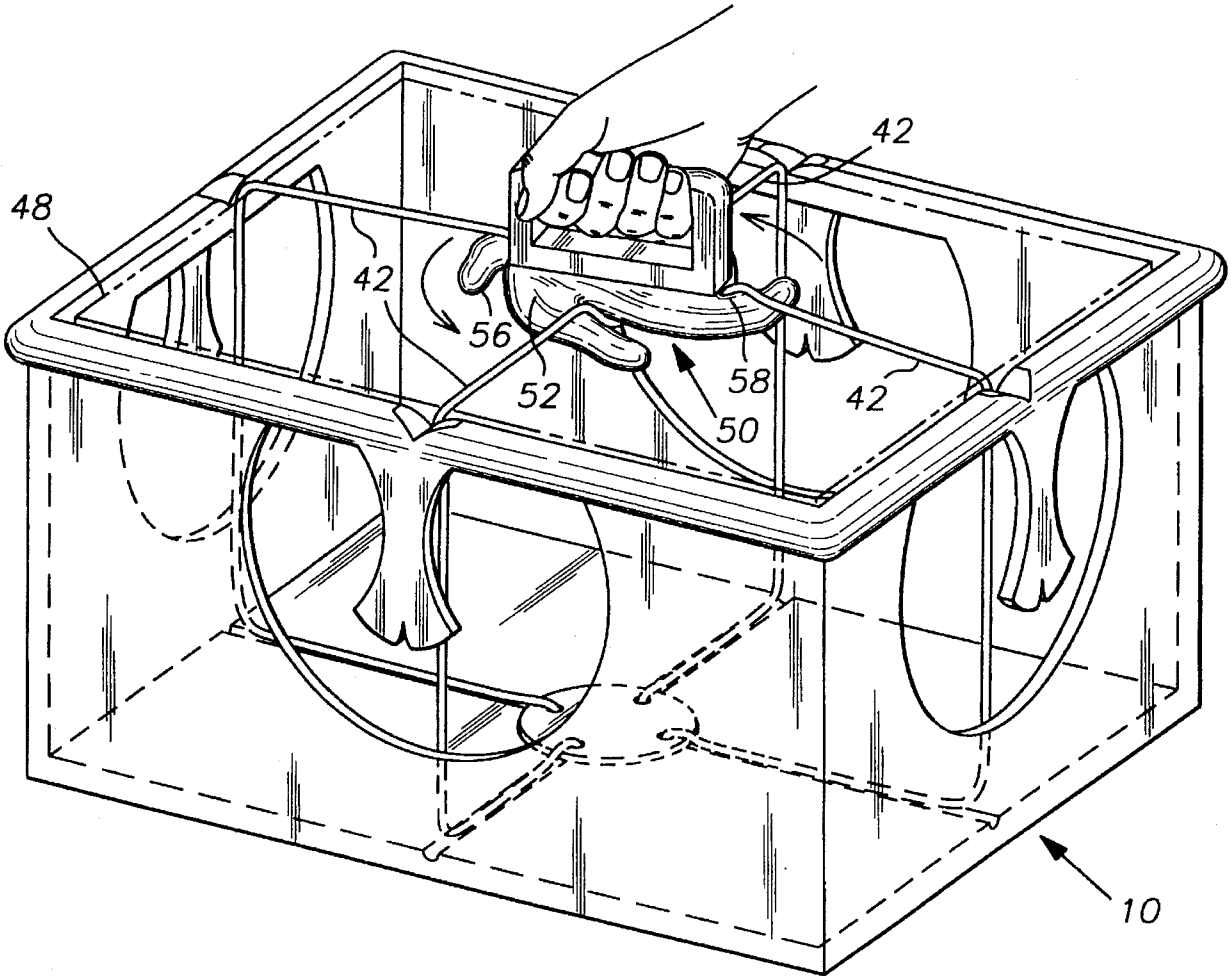
FIG. 2 is a diagrammatic perspective view of the instant invention, ready to lift a bundle from the bin.

The rope ends 42 are unwrapped from the reels 26, so that they may be tied together. Referring to FIG. 2, the rope ends 42 are brought together around a newspaper pile 48 that has been accumulated within the bin 10.

Figure 5:
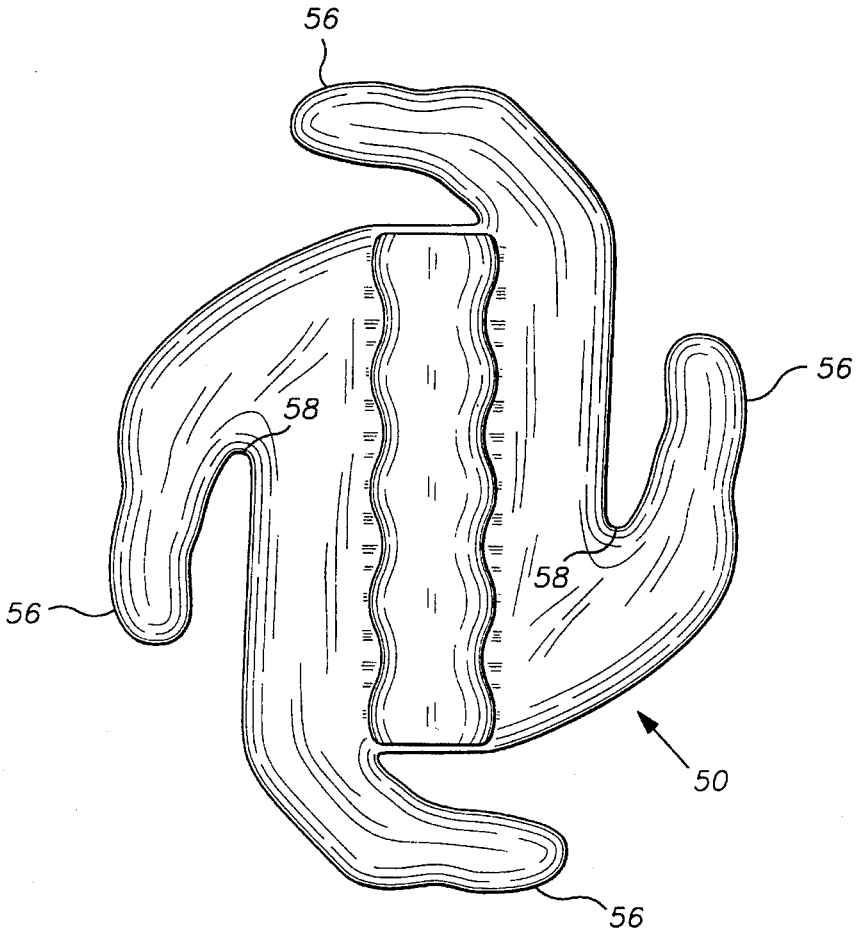
FIG. 5 is a top plan view of a handle according to the present invention.
Figure 6:
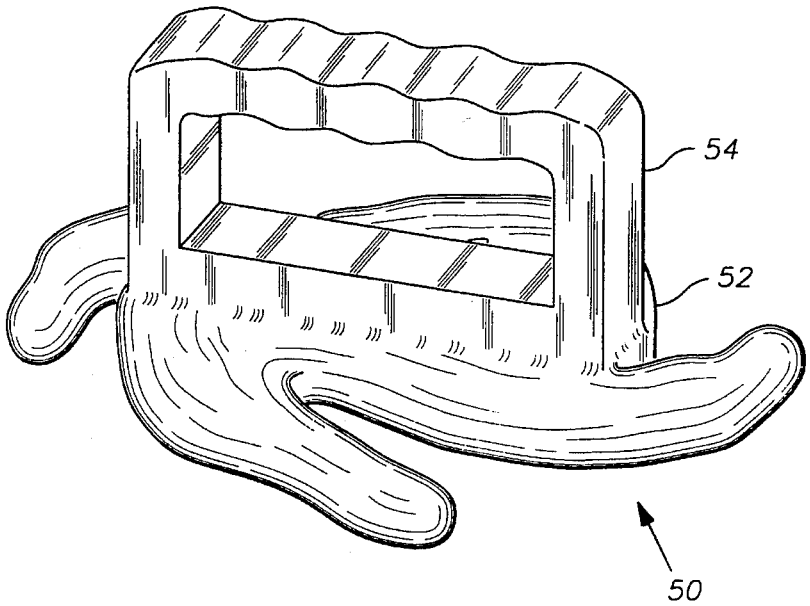
FIG. 6 is a diagrammatic perspective view of the handle.

FIG. 5 and FIG. 6 illustrate a handle 50. In FIG. 6 the handle 50 has a handle base 52 and a hand-grip 54. The handle base 52 has four hooks 56. The hooks 56 extend outward and downward from the handle base 52 in a spiral fashion. Between the handle base 52 and each hook 56 is a hook notch 58.

Referring back to FIG. 2, after the rope ends 42 are brought together around the newspaper pile 48 they are tied into a knot, with the rope ends extending from the knot in four perpendicular directions. The handle 50 is then placed on top of the knot, with the handle base 52 centered over the knot. The handle 50 is rotated, with slight downward pressure, so that each of the four hooks 56 catches one of the four rope ends 42. The rope ends 42 slide up the hooks 56 toward the hook notches 58, where they become trapped. The newspaper pile 48 can now be lifted by the handle 50. After the newspaper pile 48 is carried to a pickup point, such as the curb, the newspaper pile 48 is placed on the ground, and the handle 50 is twisted to free the rope ends 42 from the hook notches 58, so that the handle 50 may be reused.

What is claimed is:

1. A newspaper storage and bundling system, for collecting newspapers and magazines which form a newspaper pile, comprising:

a bin having a bottom panel, the bottom panel rectangular in shape and having four bottom edges, the bin having four side panels which extend perpendicularly upward from the bottom edges, the side panels attached to each other at right angles, the side panels and the bottom panel together defining a storage space;

a lip connecting the four side panels, the lip extending on the side panels opposite the bottom panel;

at least one opening positioned in at least one of the side panels so as to extend beneath the lip;

four stationary reels, each of the reels extending downward from the lip in front of the at least one opening near the center of one of the side panels;

at least one rope assembly, having a rope assembly spacer located on the bottom panel, and having four rope ends extending from the spacer, each rope end extending across the bottom panel, up the side walls, and wrapped around one of the reels.

2. The apparatus as recited in claim 1, wherein the bottom panel has a rope assembly recess for accommodating the rope assembly spacer, and four rope channels extending from the rope assembly recess, the rope channels extending in perpendicular directions to one another.

3. The apparatus as recited in claim 2, the lip has an overhang that extends perpendicular to the side panels in the direction away from the storage space, the reels extending downward from the overhang directly in front of one of the openings.

4. The apparatus as recited in claim 3, further comprising a handle having a handle base and four hooks extending outward and downward from the handle base in a spiral fashion, for catching the rope ends once the rope ends are tied.

5. The apparatus as recited in claim 4, wherein the lip further comprises a lip notch directly above each reel.

6. The apparatus as recited in claim 5, wherein the rope assembly spacer has a spacer top and further has four spacer holes, each of the rope ends exiting one of the spacer holes at the spacer top.

7. The apparatus as recited in claim 6, wherein each reel has a neck, and has a rope remainder notch opposite the lip.

8. The apparatus of claim 1 wherein the at least one opening is semicircular in shape.

* * * * *